US006601259B2

(12) United States Patent
Chang

(10) Patent No.: US 6,601,259 B2
(45) Date of Patent: Aug. 5, 2003

(54) METHOD FOR MAKING BATH BRUSH AND PRODUCT MADE THEREBY

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 114 days.

(21) Appl. No.: 09/945,823

(22) Filed: Sep. 5, 2001

(65) Prior Publication Data

US 2003/0041403 A1 Mar. 6, 2003

(51) Int. Cl.[7] ..... A47K 7/02
(52) U.S. Cl. ..... 15/209.1; 15/229.13
(58) Field of Search ..... 15/209.1, 210.1, 15/229.11, 229.12, 229.13; 300/21

(56) References Cited

U.S. PATENT DOCUMENTS 5,687,447 A * 11/1997 Bynum et al. ..... 15/229.13
6,092,258 A * 7/2000 Chen ..... 15/209.1
6,276,022 B1 * 8/2001 Gallacher ..... 15/209.1
6,453,503 B1 * 9/2002 Chen ..... 15/209.1
2002/0166189 A1 * 11/2002 Huang ..... 15/209.1
2003/0000039 A1 * 1/2003 Borcherds ..... 15/209.1

* cited by examiner

*Primary Examiner*—Terrence R. Till
(74) *Attorney, Agent, or Firm*—Browdy and Neimark, P.L.L.C.

(57) ABSTRACT

A method for making a bath brush involves the fitting of a tubular net main body with two support rods which are separated from each other by a predetermined distance. The tubular net main body is then laterally stretched before a brush handle is disposed in the middle portion of one side of the two support rods. A tightening member is used to wrap the tubular net main body which is then tightened to locate on the brush handle. The stretched main body is gradually pulled out of the two support rods such that the main body is fastened with one side of the brush handle, and that the main body expands at the tightening point serving as a center to form a loose bath ball.

1 Claim, 6 Drawing Sheets

METHOD FOR MAKING BATH BRUSH AND PRODUCT MADE THEREBY

FIELD OF THE INVENTION

The present invention relates generally to a bath brush, and more particularly to a method for making the bath brush.

BACKGROUND OF THE INVENTION

The U.S. Pat. No. 6,092,258 discloses a bath brush 20, which is shown in FIG. 1 and is formed of an elastic soft tubular net 21. The tubular net 21 is fixed on a handle 23 such that the bath brush 20 has a wavy fringe. The handle 23 is provided with a plurality of round holes 24*a*–24*h*. A lashing member 22 is put through the first round hole 24*a* to come out of the second round hole 24*b*. When the lashing member 22 is put through the second round hole 24*b*, the lashing member 22 is put through the tubular net 21 before entering the third round hole 24*c*. The lashing member 22 is put out of the fourth round hole 24*d*, and so forth. The lashing member 22 encloses the tubular net 21. It is rather time-consuming to put the lashing member 22 through the round holes 24*a*–24*h*. As a result, the prior art bath brush 20 is not cost-effective.

SUMMARY OF THE INVENTION

It is the primary objective of the present invention to provide a cost-effective method for making a bath brush.

In keeping with the principle of the present invention, the objective of the present invention is attained by a method comprising a first step in which a tubular net is fitted with two support rods separated from each other at an interval, thereby stretching the tubular net. A brush handle is fastened by a tightening member between the two support rods such that the tubular net is surrounded by the tightening member. The stretched tubular net is then pulled out of the two support members, so as to enable the tubular net to join with one side of the handle. The tubular net is released at the tightening point serving as the center. The tubular net is thus expanded to form a spherical bathball.

DETAILED DESCRIPTION OF THE INVENTION

Figure 1:
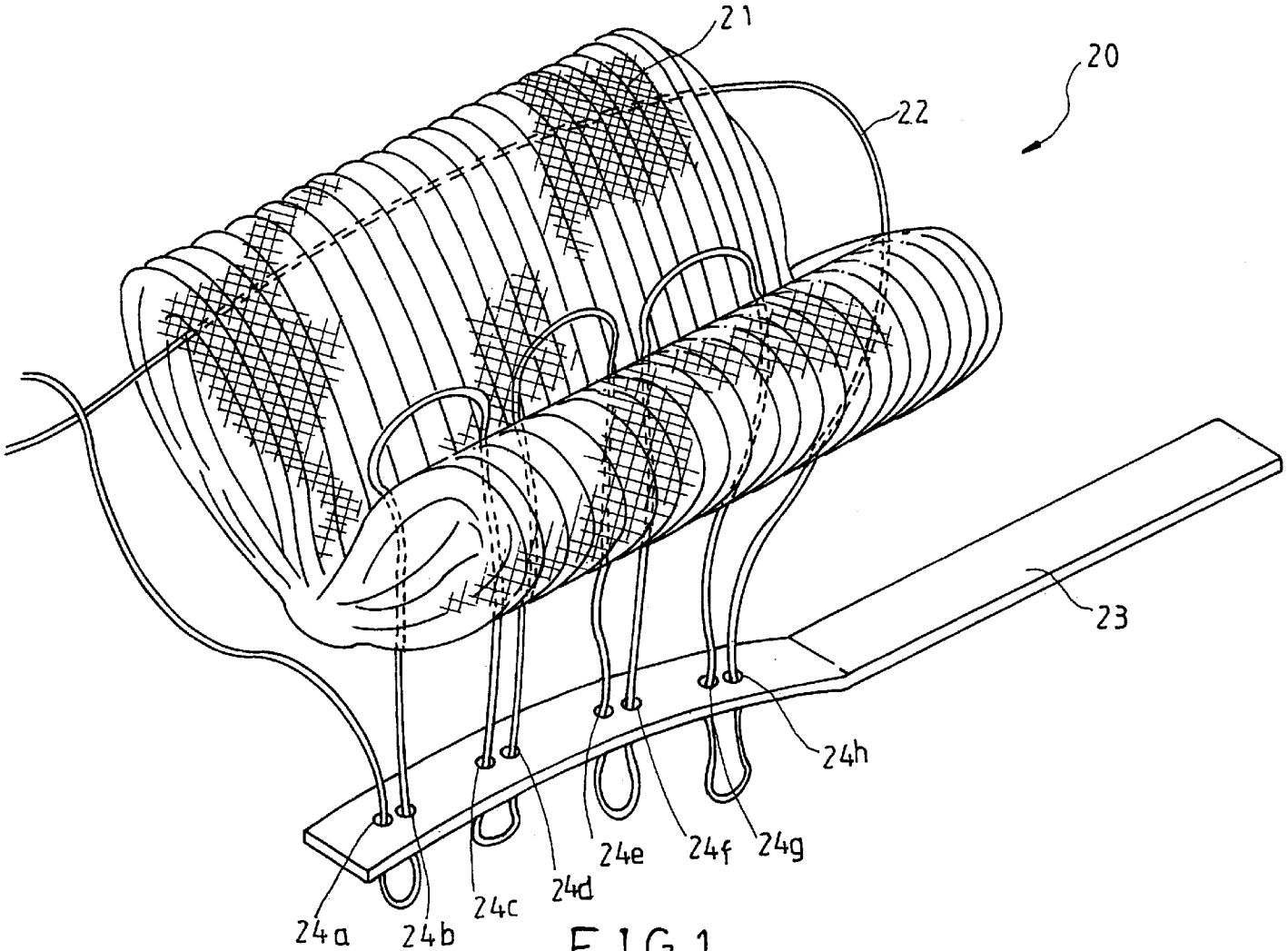
FIG 1 PRIOR ART
FIG. 1 shows a perspective view of a bath brush of the prior art.
Figure 2:
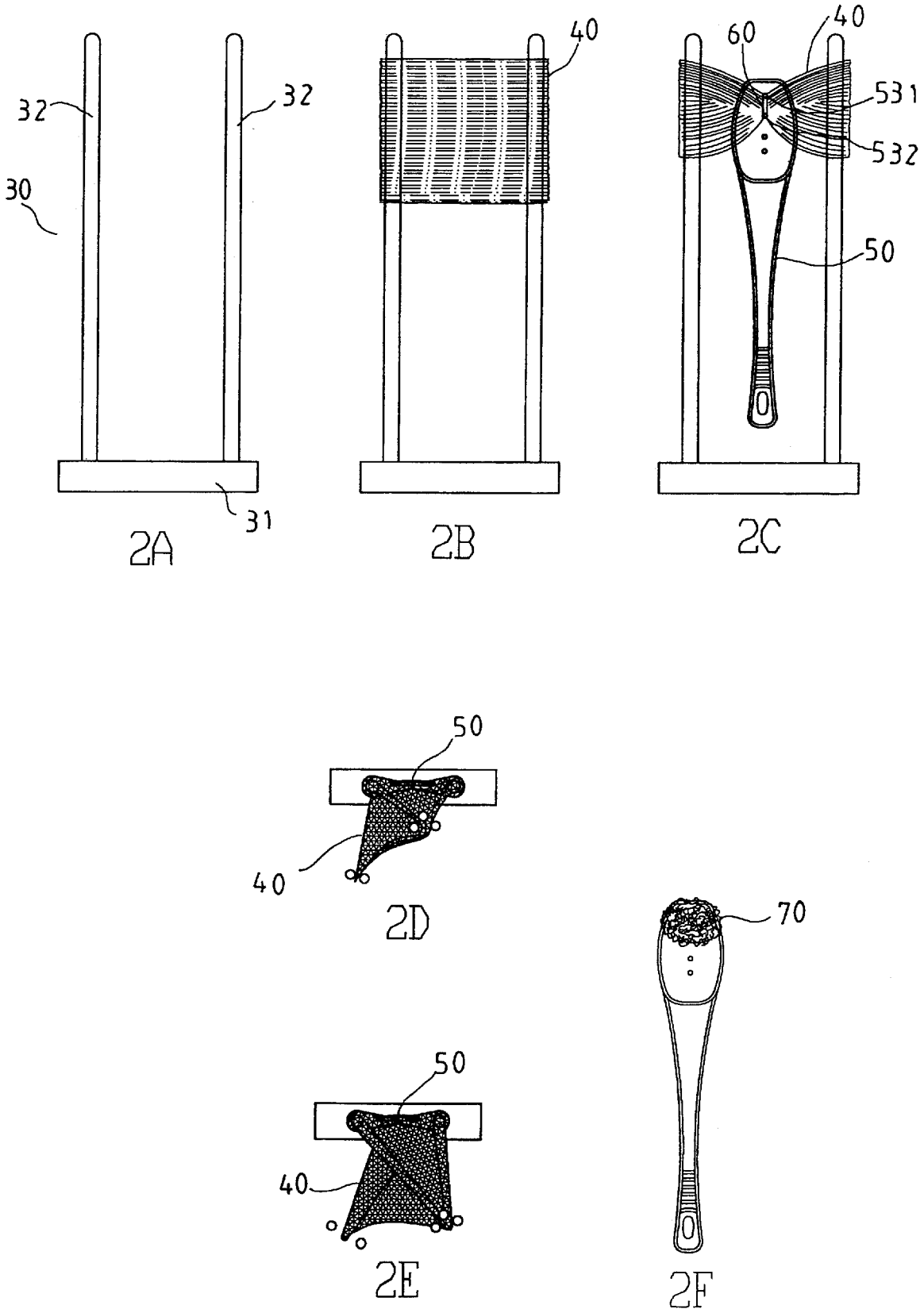
FIGS. 2A–2F shows a schematic process flow of a preferred embodiment of the present invention.
Figure 3:
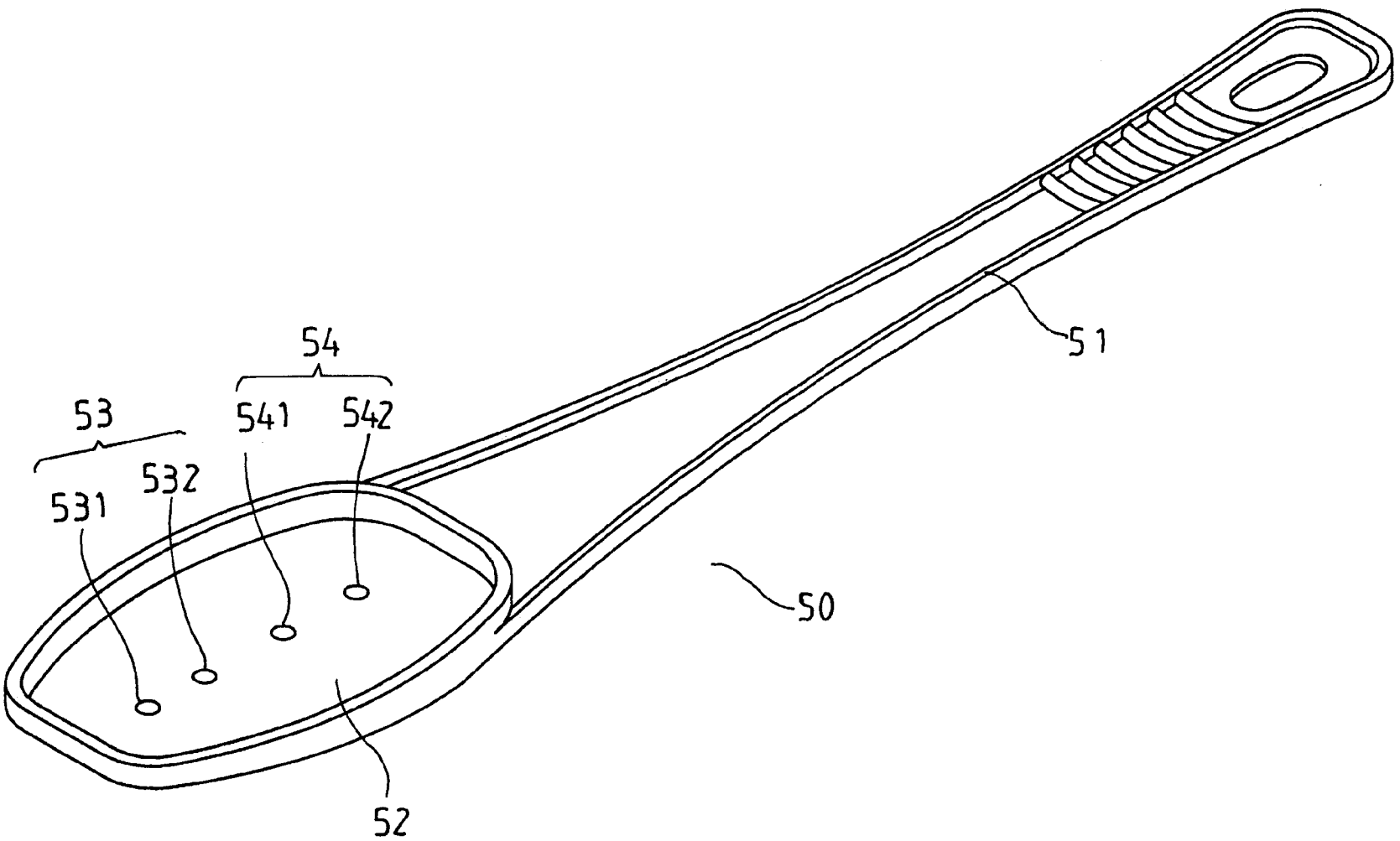
FIG. 3 shows a perspective view of a brush handle of the preferred embodiment of the present invention.
Figure 4:
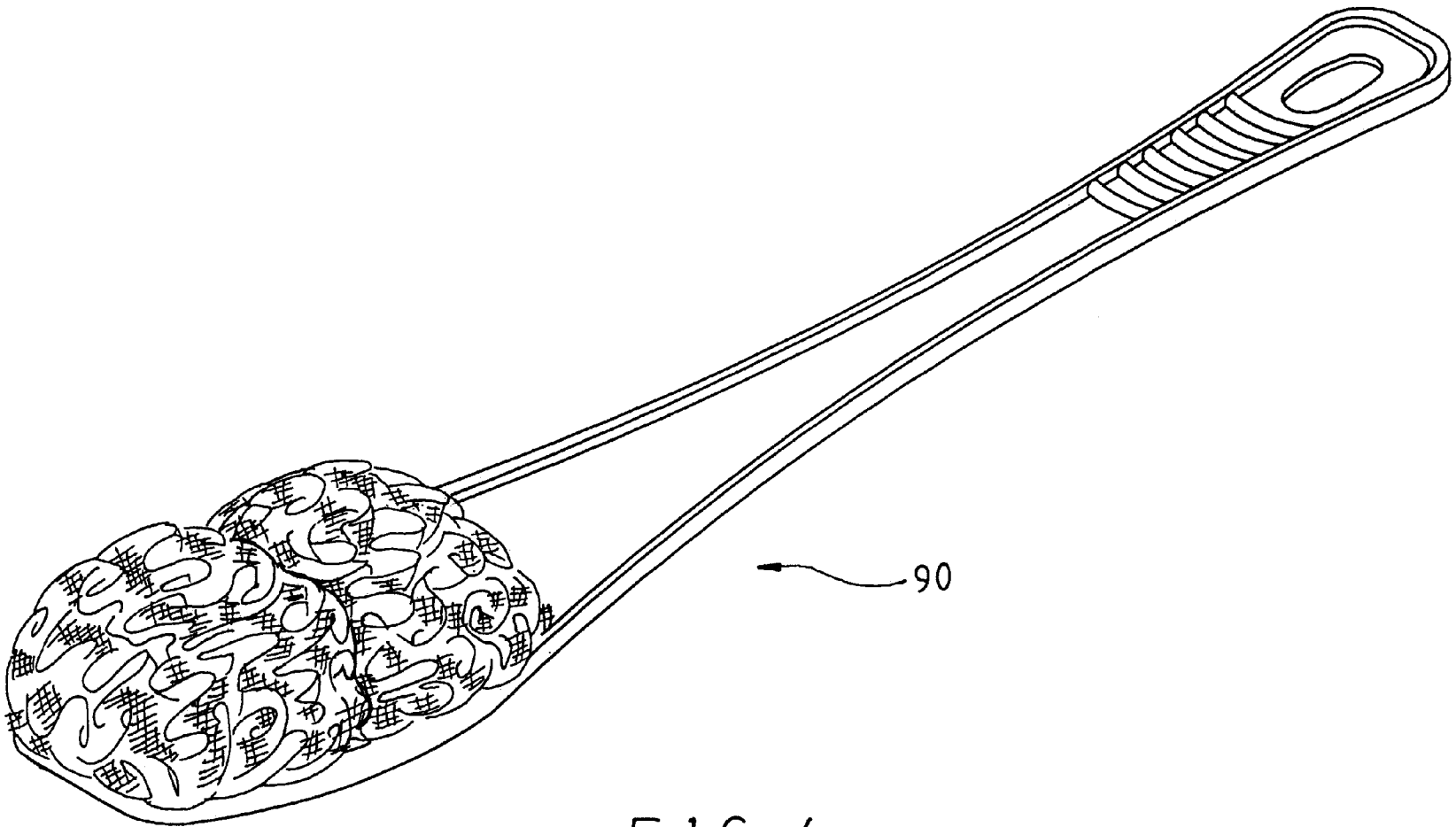
FIG. 4 shows a perspective view of a product made by the method of the preferred embodiment of the present invention.

As shown in FIGS. 2–4, a method of the present invention for making a bath brush 90 comprises the following steps:

a) As shown in FIG. 2A, a fixation member 30 is provided on a plate body 31 with two support rods 32 which are separated from each other by a predetermined distance and are fastened at the bottom end with the plate body 31, with the top ends thereof being free ends;

b) As shown in FIG. 2B, an elastic tubular net main body 40 of an appropriate length is fitted with the two support rods 32 from the top ends of the support rods 32 such that the tubular net body 40 is located between the two support rods 32, and that the tubular net body 40 is laterally stretched by the two support rods 32;

Before entering the step (c) described below, it is necessary to introduce a brush handle 50 which is required in the method of the present invention. As shown in FIG. 3, the brush handle 50 is provided at one end with a grip portion 51, and at other end with a fastening portion 52 of an oval shape and having a greater area. The fastening portion 52 is provided with two sets of through holes 53 and 54, which are respectively formed of a first through hole 531, 541, and a second through hole 532, 542. In the preferred embodiment of the present invention, the first through hole 531, 541 of the set through hole 53, 54, and the second through hole 532, 542 are linearly arranged along the longitudinal direction of the brush handle 50. However, the arrangement pattern and the through hole number are not restrictive. For example, the set through holes may be arranged in an alternate or parallel manner. The through hole number may be one or more, depending on the need.

c) As shown in FIG. 2C, the brush handle 50 is uprightly disposed on the rear side of the fixation member 30 such that one set through hole 53 of the fastening portion 52 is disposed between the support rods 32, and that the tubular net main body 40 is wrapped by a tightening member 60 before being put through the first through hole 531 and the second through hole 532 of the first set though hole 53. The center of the tubular net body 40 is tightened to fasten with the front side of the fastening portion 52 of the brush handle 50;

d) The tubular net main body 40 is pulled out of the top ends of the two support rods 32, as shown in FIGS. 2D and 2E. The tubular net main body 40 is loose when it is pulled out. The tubular net main body 40 is located on the fastening portion 52 by the tightening member 60 such that a bathball 70 is formed, as shown in FIG. 2F;

In order to enhance the density of the bath brush of the present invention, the set through hole 54 of the fastening portion 52 of the brush handle 50 is disposed between the two support rods 32 which are fitted with a tubular net main body 40, thereby bringing about the production of the second brush ball. The method for making the second brush ball is the same as that for making the first brush ball, as shown in FIGS. 2A–2F.

As shown in FIG. 4, the bath brush 90 is the finished product of the method of the present invention.

Figure 5:
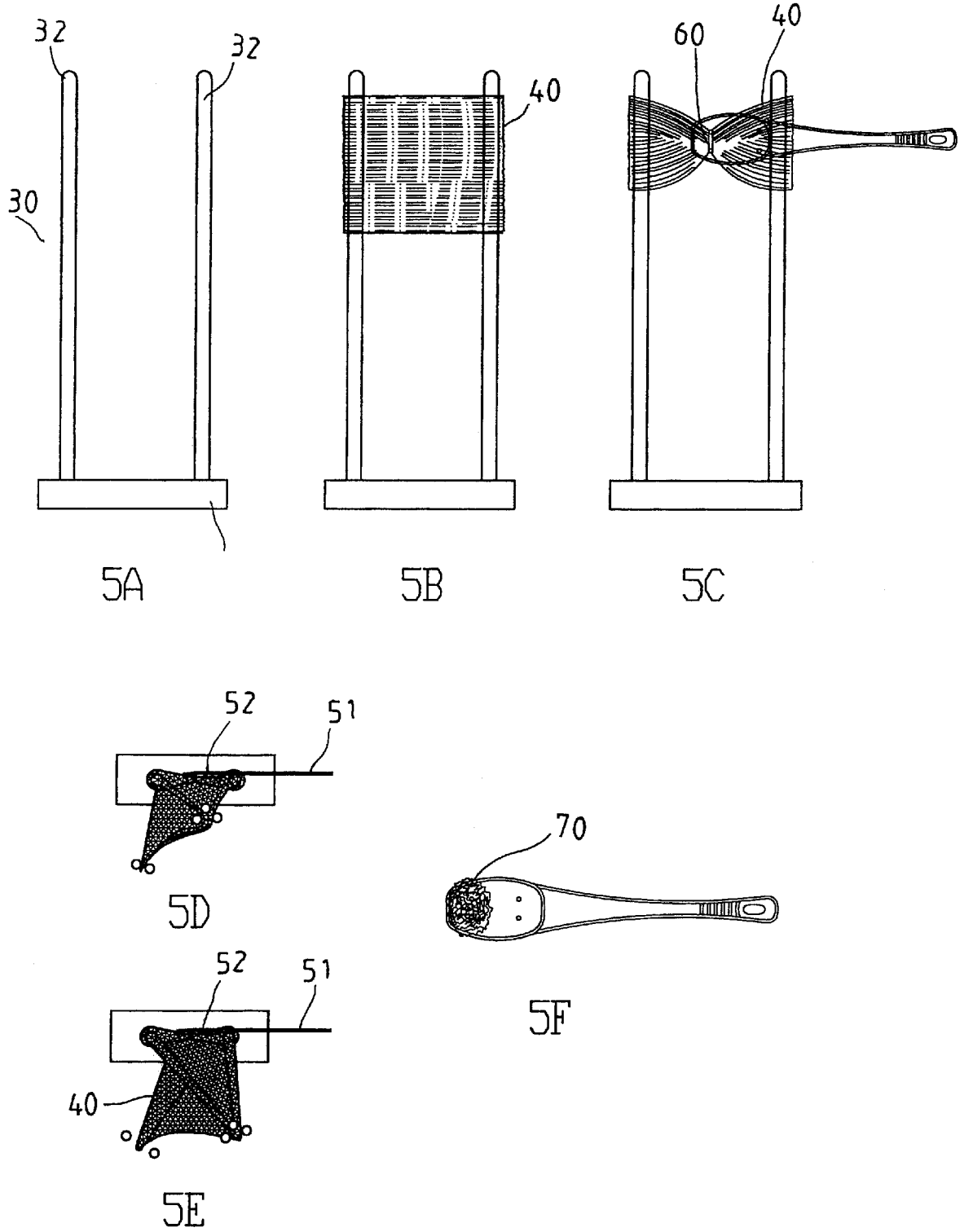
FIGS. 5A–5F shows a schematic process flow of another preferred embodiment of the present invention.
Figure 6:
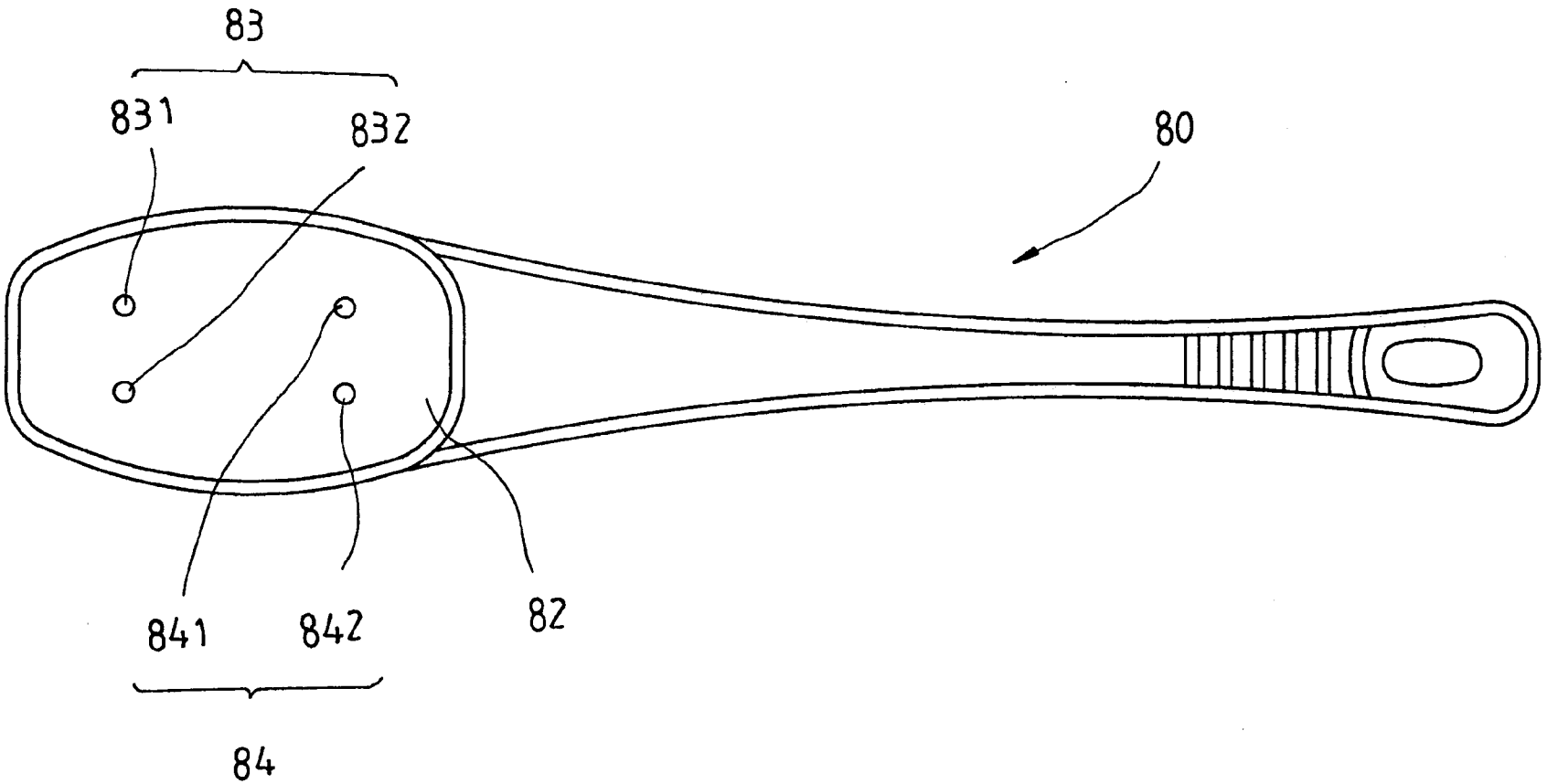
FIG. 6 shows a schematic plan view of a brush handle of another preferred embodiment of the present invention.

As shown in FIGS. 5–6, a brush handle 80 of another preferred embodiment of the present invention has a structure which is basically unchanged, except that the first through hole 831, 841 and the second through hole 832, 842 of the two set through holes 83 and 84 are arranged on the fastening portion 82 such that they are perpendicular to the longitudinal direction of the brush handle 80. Thereafter, the action of tightening the bath ball is carried out, with the only difference being that the brush handle 80 is horizontally disposed on one side of the fixation member 30.

The method for making a bath brush 90 involves the process of disposing the brush handle 50 in one side of the fixation member 30 fitted with the main body 40 which is wrapped and tightened by a tightening member 60 such that the main body 40 is located on the fastening portion 52 of the brush handle 50, and that two sides of the main body 40 are stretched, and that the main body 40 expands from the tightening point serving as a center, thereby resulting in formation of a bathball 70. The underside of the bathball 70 is in contact with the fastening portion 52 of the brush handle 50. The fastening portion 52 has a greater area for supporting the bath ball 70 to bring about a better cleaning effect on the body skin of a person. The method of the present invention is cost effective and is free of the deficiencies of the prior art methods.

The fastening portion of the brush handle may be provided with three or more sets of through holes in conjunction with the corresponding number of the tightening members and the tubular net main bodies. As a result, the brush handle is provided with a plurality of bath balls which are arranged compactly.

What is claimed is:

1. A method for making a bath brush, the method comprising the steps of:

a. preparing a fixation member which has two support rods separated from each other by a predetermined distance;

b. fitting an elastic tubular net main body over said two support rods such that the tubular net main body is laterally stretched by the two support rods;

c. preparing a brush handle, said brush handle having at one end a plurality of through holes for disposing two or more tubular net main bodies;

d. disposing the brush handle in one side of the fixation member such that the through hole is located between the two support rods;

e. using a tightening member to wrap the tubular net main bodies which are fitted between the two support rods such that the tubular net main bodies are located on the brush handle by the tightening member via the through hole;

f. gradually pulling the tubular net main bodies in a predetermined direction until such time that the tubular main bodies are completely pulled out of the two support rods, whereby the tubular net main bodies are expanded to form spherical bath balls.

* * * * *